US007827747B2

(12) United States Patent
George et al.

(10) Patent No.: US 7,827,747 B2
(45) Date of Patent: Nov. 9, 2010

(54) FOOTING FORM FOR UPRIGHT STRUCTURAL MEMBERS OF BUILDINGS

(76) Inventors: Glen R. George, 13390 Summer La., Grand Ledge, MI (US) 48813; Gerald J. Eckhoff, 473 White Oak La., Barrington, IL (US) 60010

( * ) Notice: Subject to any disclaimer, the term of this patent is extended or adjusted under 35 U.S.C. 154(b) by 596 days.

(21) Appl. No.: 11/776,240

(22) Filed: Jul. 11, 2007

(65) Prior Publication Data

US 2008/0016795 A1 Jan. 24, 2008

Related U.S. Application Data

(60) Provisional application No. 60/830,091, filed on Jul. 11, 2006.

(51) Int. Cl.
*E02D 27/42* (2006.01)
*E02D 27/00* (2006.01)

(52) U.S. Cl. ..... 52/292; 52/169.13; 52/297; 52/298; 52/299; 248/346.01; 248/530

(58) Field of Classification Search ..... 52/40, 52/165, 166, 169.13, 170, 297, 704, 708, 52/745.15, 292, 709, 298; 248/346.01, 346.05, 248/519, 530, 357, 678; 404/36; 405/255
See application file for complete search history.

(56) References Cited

U.S. PATENT DOCUMENTS 646,970 A 4/1900 Francis
725,820 A 4/1903 Beazley
738,850 A 9/1903 Schug
843,762 A * 2/1907 Muller ..... 52/298
877,768 A 1/1908 Head
892,592 A 7/1908 Helm
975,135 A 11/1910 Kelsey et al.
1,170,049 A 2/1916 Cunningham
1,248,691 A 12/1917 Meisler
1,296,995 A 3/1919 Miller
1,300,393 A 4/1919 Hodges
1,313,005 A 8/1919 Meyer et al.
1,374,864 A 4/1921 Rashkovsky
1,445,907 A 2/1923 Novy
1,554,833 A 9/1925 Armstrong
1,611,935 A 12/1926 Mitchell
1,696,288 A * 12/1928 Underwood ..... 52/296

(Continued)

FOREIGN PATENT DOCUMENTS

GB 2123872 2/1984

*Primary Examiner*—Robert J Canfield
(74) *Attorney, Agent, or Firm*—Price, Heneveld, Cooper, DeWitt & Litton, LLP

(57) ABSTRACT

A footing form for supporting posts or other upright structural members of buildings and the like includes a primary web, and a plurality of structural webs extending upwardly from the primary web. The webs include structural webs that extend radially outward from a center portion of the base web, and a plurality of ring-like concentric webs that provide additional structural support. The webs form a plurality of upwardly-opening pockets, and apertures through the base web provide for drainage of water and the like from the upwardly-opening pockets. The footing form may have a one-piece molded construction. The footing form provides sufficient support to thereby eliminate the need for concrete or the like to support the posts.

38 Claims, 9 Drawing Sheets

U.S. PATENT DOCUMENTS 2,040,010 A * 5/1936 McMahon ..... 52/127.2
2,210,441 A * 8/1940 Bachman ..... 52/297
2,618,037 A 11/1952 Miller
2,724,156 A 11/1955 Shaw
2,809,415 A 10/1957 Couëlle
2,831,231 A 4/1958 Toensing
2,866,250 A 12/1958 Ford et al.
2,955,331 A 10/1960 Nelson
3,024,512 A 3/1962 Dyer
3,059,279 A 10/1962 Rossi
3,108,403 A 10/1963 Jackson
3,159,899 A 12/1964 Pafenberg
3,159,900 A 12/1964 Pafenberg
3,282,001 A 11/1966 Bigalow
3,417,525 A 12/1968 Dashio
3,467,490 A 9/1969 Sommer
3,611,736 A 10/1971 Goodman
3,691,776 A 9/1972 Hull
3,698,144 A * 10/1972 Stratton ..... 52/99
3,823,785 A * 7/1974 Toliver ..... 173/90
4,189,125 A 2/1980 Little
4,222,493 A 9/1980 Friedman
4,244,156 A 1/1981 Watts, Jr.
4,250,235 A * 2/1981 DuPont et al. ..... 429/211
4,254,927 A 3/1981 Stonhaus
4,269,010 A 5/1981 Glass
D278,684 S 5/1985 Sussman
4,648,220 A 3/1987 Gebelius
4,671,699 A * 6/1987 Roach ..... 404/41
4,673,157 A 6/1987 Wells
4,767,241 A 8/1988 Wells
4,779,735 A 10/1988 Kelso, Jr.
4,783,935 A 11/1988 Creager
4,799,340 A 1/1989 Lichau et al.
4,830,543 A 5/1989 Joubert
4,854,542 A 8/1989 Pruett
4,869,456 A 9/1989 Jacobs
4,908,085 A 3/1990 Makus et al.
4,946,725 A 8/1990 Harlan
4,972,642 A 11/1990 Strobl, Jr.
5,090,165 A 2/1992 Kenny
5,138,806 A 8/1992 Marx et al.
5,205,411 A * 4/1993 Born et al. ..... 206/391
5,271,203 A 12/1993 Nagle
5,315,796 A 5/1994 Gruhlke
5,328,142 A 7/1994 Weekers
5,340,298 A * 8/1994 Beatty et al. ..... 425/183
5,344,013 A * 9/1994 Born et al. ..... 206/391
5,419,524 A 5/1995 Evans et al.
5,492,429 A 2/1996 Hodges
5,503,500 A 4/1996 Oliver et al.
5,516,236 A 5/1996 Williams et al.
5,564,669 A * 10/1996 Wu ..... 248/346.01
5,571,229 A 11/1996 Fitzsimmons et al.
5,625,988 A 5/1997 Killick
5,733,613 A 3/1998 Baecker
D393,474 S 4/1998 Swinimer
D394,271 S 5/1998 Croghan
5,752,349 A 5/1998 Fitzsimmons et al.
5,758,460 A 6/1998 MacKarvich
5,785,459 A 7/1998 Swinimer
5,800,727 A 9/1998 Croghan
5,816,554 A 10/1998 McCracken
5,890,333 A 4/1999 Boroviak
5,891,583 A 4/1999 George
5,953,874 A 9/1999 Hoffman et al.
5,961,093 A * 10/1999 Jones et al. ..... 248/678
6,041,559 A 3/2000 Schickert et al.
6,098,353 A 8/2000 Stanfield
6,141,936 A 11/2000 Butler, Jr.
6,318,700 B1 11/2001 Cliff
6,324,800 B1 12/2001 Valentz et al.
6,345,474 B1 2/2002 Triplett
6,389,760 B1 5/2002 McDonnell
6,513,291 B2 2/2003 Gilsdorf
6,543,742 B2 4/2003 Wells
6,786,463 B1 9/2004 Collum
6,868,641 B2 * 3/2005 Conner et al. ..... 52/98
6,886,296 B1 * 5/2005 John et al. ..... 52/170
6,928,933 B2 * 8/2005 Grau ..... 108/57.25
7,341,220 B2 * 3/2008 Katayama ..... 242/614
2002/0145097 A1 * 10/2002 Bruschi et al. ..... 248/346.01
2002/0185582 A1 * 12/2002 Li ..... 248/522
2003/0061781 A1 4/2003 Smith
2004/0134820 A1 * 7/2004 Katayama ..... 206/389
2007/0120035 A1 * 5/2007 Albanese et al. ..... 248/530
2008/0040957 A1 * 2/2008 Wish et al. ..... 40/363
2009/0101786 A1 * 4/2009 Faull et al. ..... 248/425

* cited by examiner

FOOTING FORM FOR UPRIGHT STRUCTURAL MEMBERS OF BUILDINGS

CROSS-REFERENCE TO RELATED APPLICATIONS

This application claims the benefit of U.S. Provisional Patent Application No. 60/830,091, filed on Jul. 11, 2006, the entire contents of which are incorporated herein by reference.

BACKGROUND OF THE INVENTION

Upright structural members (e.g., posts) are commonly used in building structures such as post frame structures and the like. Upright structural members are also commonly utilized to support decks and other structures. Such posts may need to support substantial vertical and side loads. One method that has been developed for supporting such posts includes digging a hole, and pouring concrete in the hole. The concrete may be supported/formed utilizing a tubular form known as a sonotube that is positioned in the opening prior to pouring of the concrete.

SUMMARY OF THE INVENTION

The present invention relates to a footing form or support that can be utilized to support posts in an upright position without the use of concrete or the like. According to one aspect of the present invention, the footing form of the present invention includes a structure that may be disk-like in shape, with a generally planar lower web defining a center, a central portion proximate the center, and a peripheral outer edge portion. The disk-like structure includes a plurality of upright structural webs extending from the central portion of the lower web to the peripheral outer edge portion of the lower web. The upright structural webs include upper edge surface portions forming at least a part of an upper support surface of the disk-like structure such that loads on the disk-like structure from an upright structural member such as a post are distributed outwardly by the upright structural webs to the lower web. The disk-like structure further includes a plurality of concentric circular upright webs extending around the center of the lower webs. The concentric circular webs, the structural webs, and the lower web together define a plurality of upwardly-opening pockets. The disk-like structure may include at least one aperture through the lower web at the bottom of each pocket to provide for drainage of water and the like from the pockets. The disk-like structure may comprise a one-piece molded member that is made from fiber-reinforced polymer or the like.

The footing form may optionally include a protective sleeve that fits over an upright post or the like. The upright sleeve may include a pin that fits into a keyhole-shaped opening in the planar lower web to interconnect the sleeve to the disk-like lower piece. The sleeve may include inwardly-protruding barbs or retaining features that engage slots or the like cut in side surfaces of a post to thereby interconnect the post and sleeve. The barbs may be one-way members that permit a post or the like to be inserted into the sleeve, yet prevent removal of the post/upright structural member from the sleeve.

During construction, a hole is dug in the earth, and the disk-like structure is positioned at the bottom of the hole. The post is then positioned in the hole on the footing, and the hole is then filled with dirt or the like. If the footing form includes a sleeve to cover the lower portion of the posts, the sleeve is positioned on the lower end of the post after the disk-like portion of the footing form is positioned at the bottom of the hole. Notches or the like may be sawed into the side surfaces of the post prior to insertion of the post into the sleeve. The one-way notches on the sleeve are received in the notches on the post to thereby retain the post in the sleeve. The post and sleeve may be connected to the disk-like portion of the footing form by inserting the pin at the bottom of the sleeve into the keyhole-shaped opening in the lower web, and the sleeve and post are then shifted sideways to engage the pin with the narrow portion of the keyhole-shaped opening. It will be understood that the sleeve portion may be connected to the disk-like portion prior to positioning of the footing form in the hole, the disk-like portion may be first positioned in the hole, followed by connection of the sleeve to the disk-like portion. Also, the post may be inserted into the sleeve prior to connection of the sleeve to the disk-like portion, or the post may be inserted into the sleeve after the sleeve has been connected to the disk-like portion.

These and other features, advantages, and objects of the present invention will be further understood and appreciated by those skilled in the art by reference to the following specification, claims, and appended drawings.

BRIEF DESCRIPTION OF THE DRAWINGS

FIG. 3;

FIG. 6;

FIG. 7.

DETAILED DESCRIPTION OF PREFERRED EMBODIMENT

Figure 1:
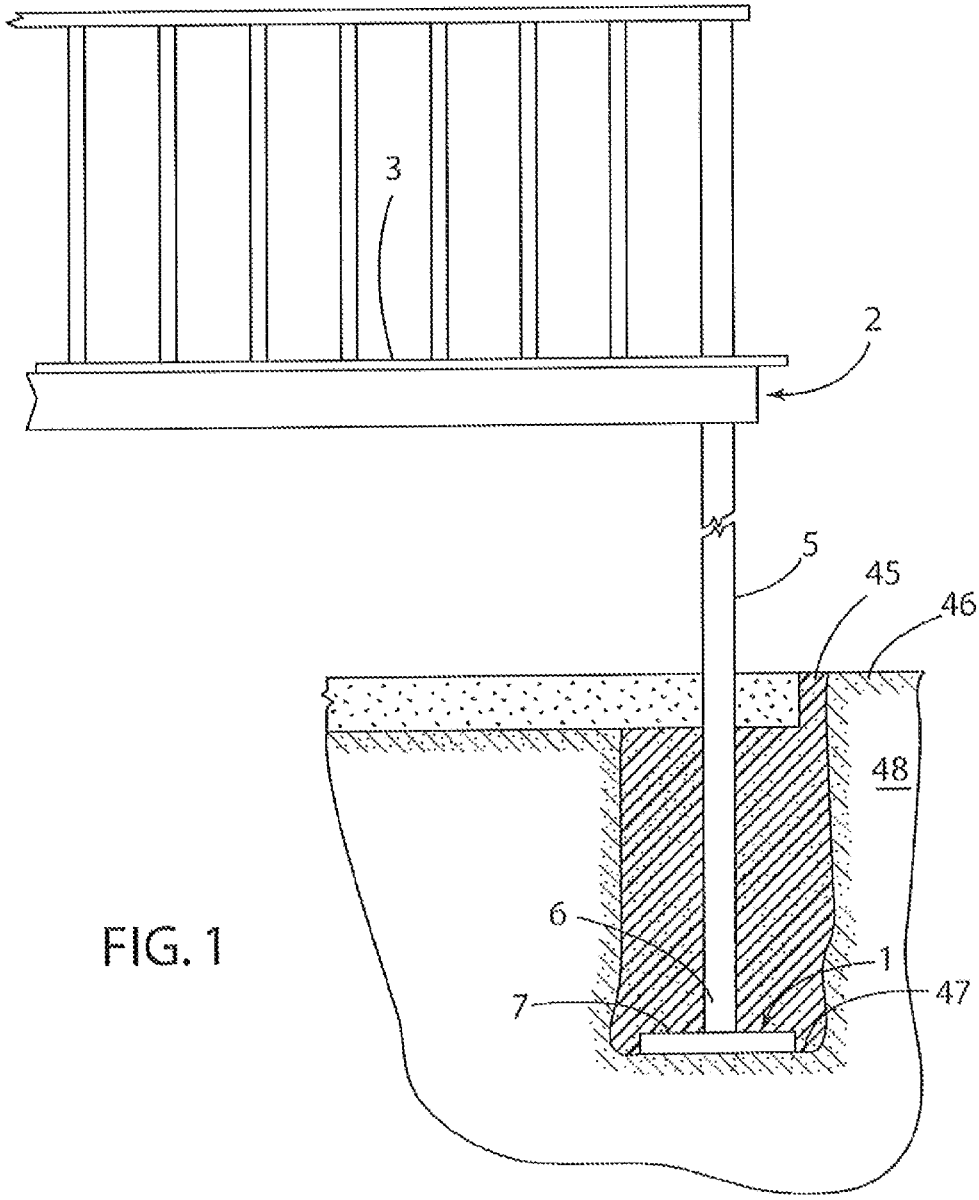
FIG. 1 is a partially fragmentary side view of a building structure such as a deck or the like having an upright structural member supported by a footing form according to one aspect of the present invention.

For purposes of description herein, the terms "upper," "lower," "right," "left," "rear," "front, " "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

With reference to FIG. 1, a footing form 1 according to one aspect of the present invention may be utilized to support a stationary building structure 2 such as a deck structure 3 or the like. The deck 3 includes one or more generally upright support posts 5 having a lower end 6 that is abuttingly supported on an upper support surface 7 of footing form 1.

Figure 2:
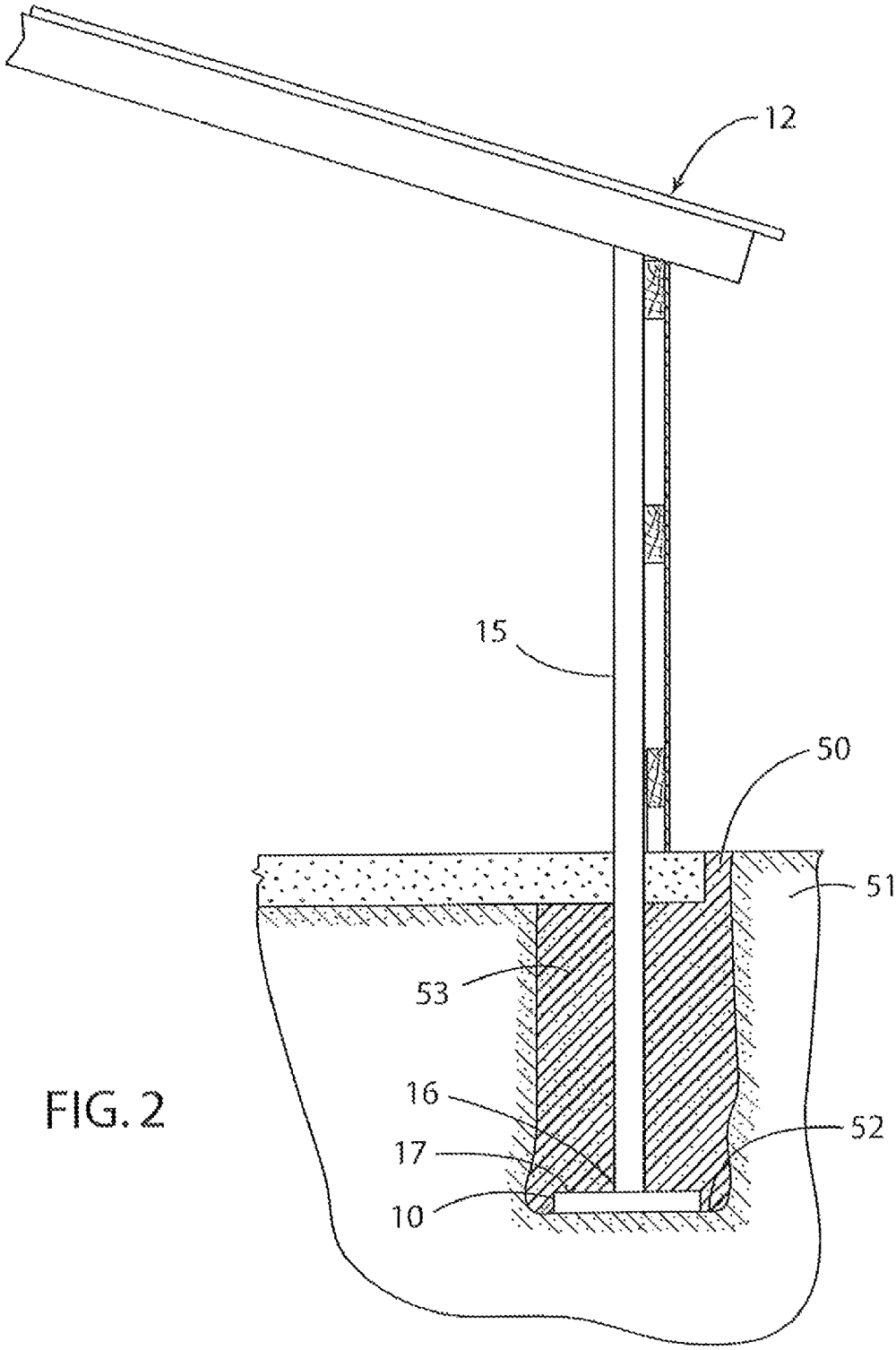
FIG. 2 is a partially fragmentary view of a post frame building structure having an upright structural member that is supported by a footing form according to another aspect of the present invention.

With further reference to FIG. 2, a footing form 10 according to another aspect of the present invention may be utilized to support a post frame building structure 12 or the like having one or more generally upright posts 15. The post 15 has a lower end 16 that is abuttingly supported on an upper surface 17 of footing form 10. As described in more detail below, footing form 10 is substantially similar to footing form 1, except that footing form 10 is larger to support the increased weight of building structure 12 and posts 15. The footing form of the present invention may be utilized to support a wide variety of structures having a wide variety of loading conditions and soil conditions.

Figure 3:
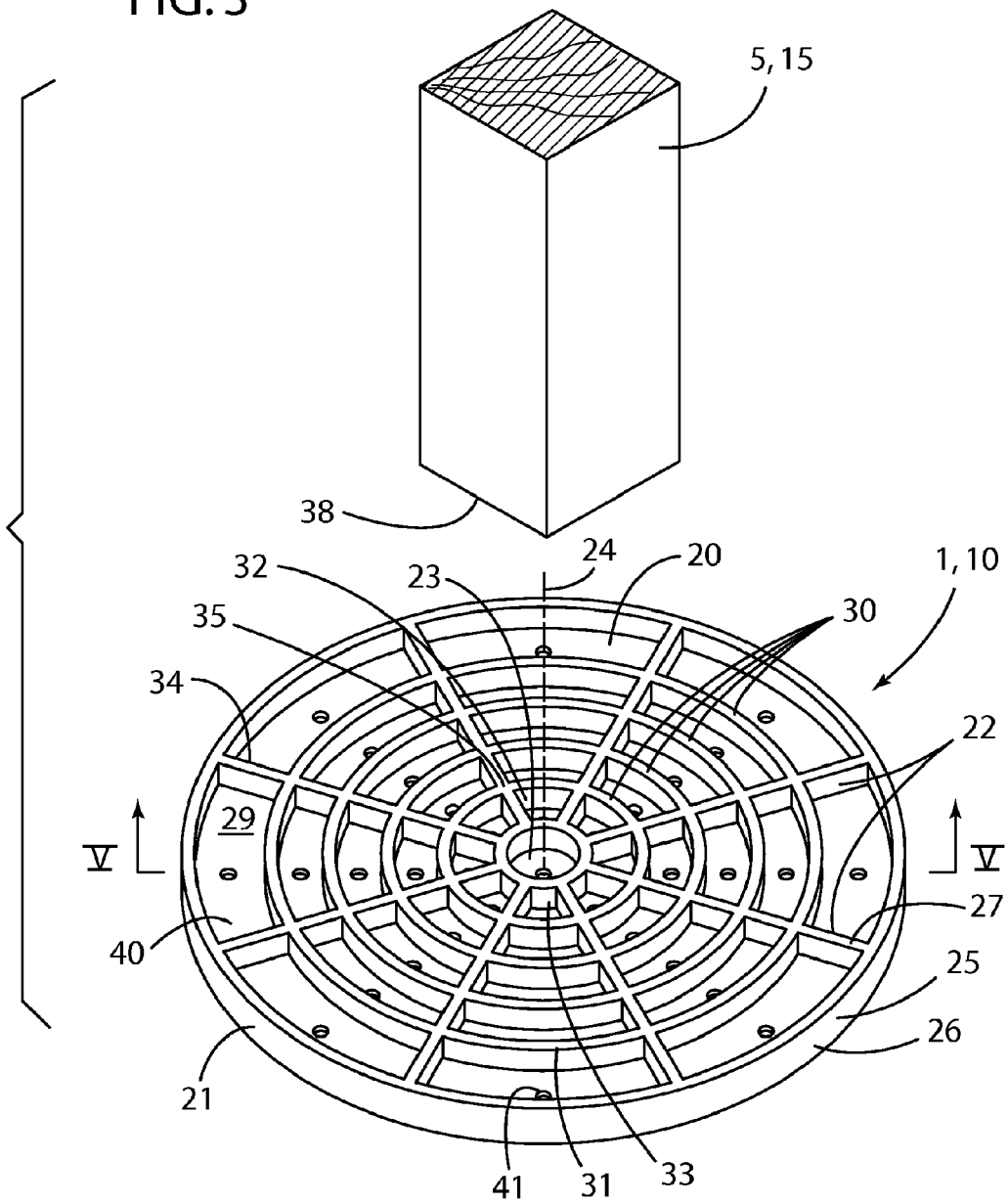
FIG. 3 is an exploded isometric view of a footing form and a post according to one aspect of the present invention.
Figure 4:
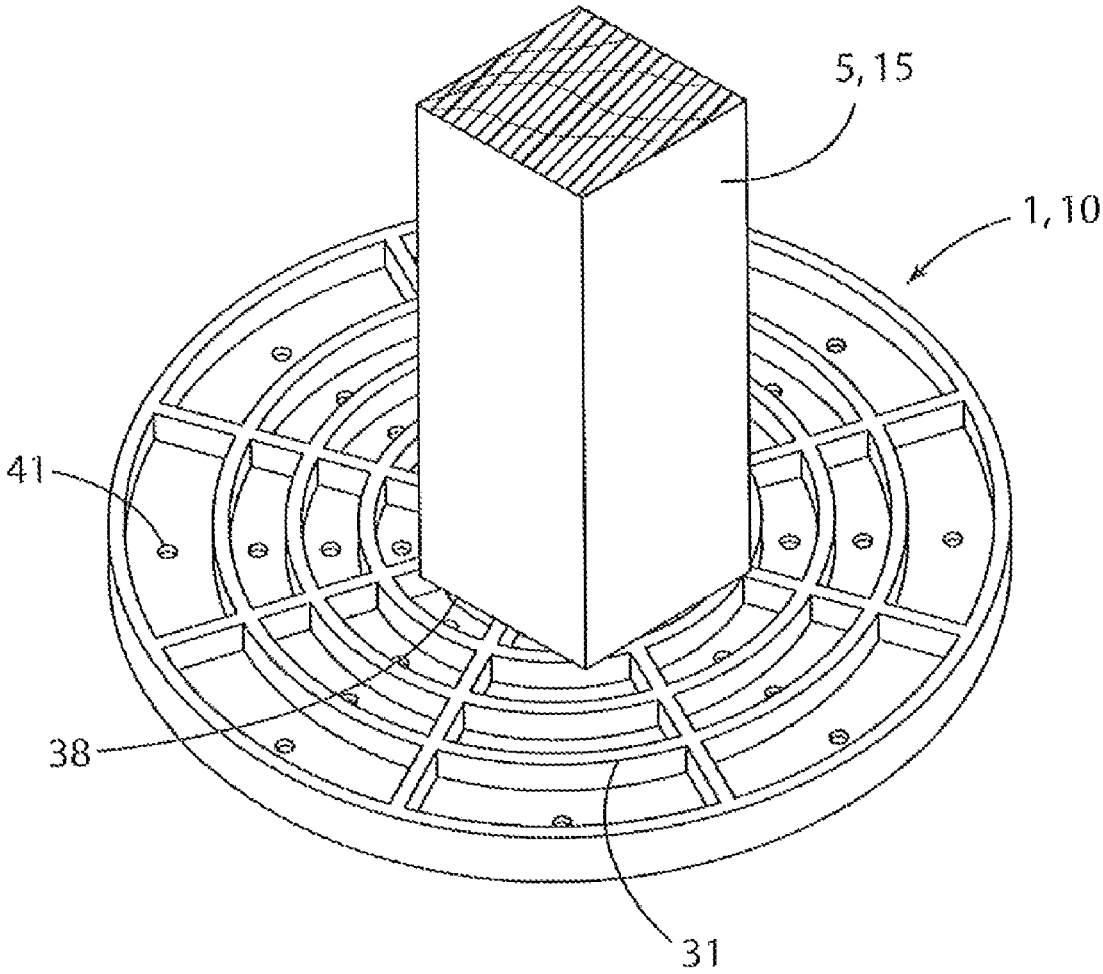
FIG. 4 shows the footing form and post positioned on the footing form.
Figure 5:
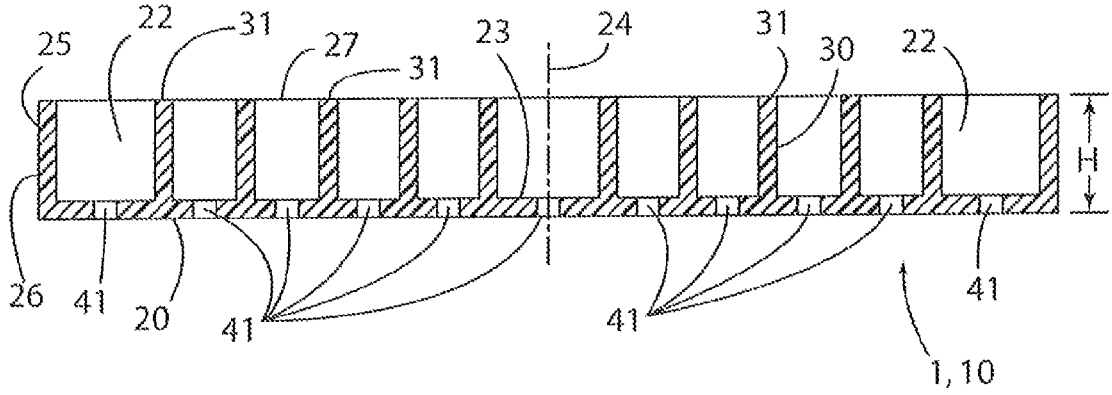
FIG. 5 is a cross-sectional view of the footing form taken along the line V-V.

With further reference to FIGS. 3-5, footing forms 1 and 10 may have a disk-like shape and include a generally planar base web 20 having an outer peripheral edge portion 21 that may be circular. Footing forms 1 and 10 are substantially similar, except that the footing form 10 is larger than footing form 1 to accommodate greater loads. It will therefore be understood that the description of the footing form below in connection with FIGS. 3-5 generally applies to both footing form 1 and footing form 10. A plurality of structural webs 22 extend upwardly from the base web 20, and also extend from a central portion 23 of base web 20 to the outer edge portion 21 of base web 20. In a preferred embodiment, the structural webs 22 extend radially outward from a center axis 24 of base web 20 to an outer circular web 25. Circular web 25 extends upwardly from base web 20 at outer edge portion 21 of base web 20 to form a generally cylindrical outer peripheral surface 26 of footing form 1. Structural webs 22 are preferably of planar, uniform thickness, with an upper edge surface 27 that is a uniform distance from upper surface 29 of base web 20. In the illustrated example, the footing form 1 includes eight structural webs 22. However, it will be understood that the number of structural webs 22 may be varied as required to provide the desired degree of structural rigidity and strength. The structural webs 22 and outer web 25 are preferably integrally formed with base web 20.

In addition to the structural webs 22, footing form 1 also includes a plurality of ring-like concentric webs 30 that extend upwardly from base web 20. The concentric webs 30 have an upper edge surface 31 that is preferably at the same height as upper edge surface 27 of structural webs 22. In the illustrated example, structural webs 22 are integrally formed with base web 20, with inner ends 33 that are integrally formed with an innermost concentric web 32, and outer ends 34 that are integrally formed with outer circular web 25. In the illustrated example, the upper edge surfaces 27 of structural webs 22 and the upper edge surfaces 31 of concentric webs 30 and 32 form upper support surface 7 that, in use, abuttingly supports a lower end 38 of a post 5 or 15.

The structural edge 22 and concentric webs 30 together define a plurality of upwardly-opening pockets 40. A plurality of apertures 41 through base web 20 provide for drainage of water and the like from the pockets 40. Preferably, each pocket 40 includes at least one aperture 41 through base web 20.

In a preferred embodiment, the footing forms 1 and 10 are made of an injection molded polymer material having fiber reinforcement material mixed in to provide a composite material. The footing forms 1 and 10 are preferably of a one-piece integrally-molded construction. This construction allows the footing forms 1 and 10 to be fabricated in a very cost-effective manner, and eliminates the cost associated with multiple-piece arrangements. In a preferred embodiment, the base web 20, structural webs 22, and concentric webs 30 are planar with a generally uniform cross-sectional thickness. However, the thickness, size, and shape of the webs may vary. For example the webs 22 and 30 may be tapered somewhat to facilitate removal of the footing form 1 from the mold tool during the production process. Also, various web thicknesses and shapes may be utilized without departing from the scope of the present invention.

In the description given above in connection with FIGS. 3-5, the footing forms 1 and 10 are shown as having eight structural webs 22, and six concentric circular webs including innermost web 32, intermediate concentric webs 30, and an outer web 25. However, it will be understood that the number and position of the webs may vary depending upon the size of the footing form. For example, in general, the footing form 10 will have more concentric webs than does footing form 1 due to the increased size of footing form 10 relative to footing form 1. Also, the height "H" (FIG. 5) of the footing form 10 may be greater than the height "H" of footing form 1. In the illustrated example, the footing form 1 has a height of about 1.0 inches, and the footing form 10 has a height of about 1.5 inches.

Figure 6:
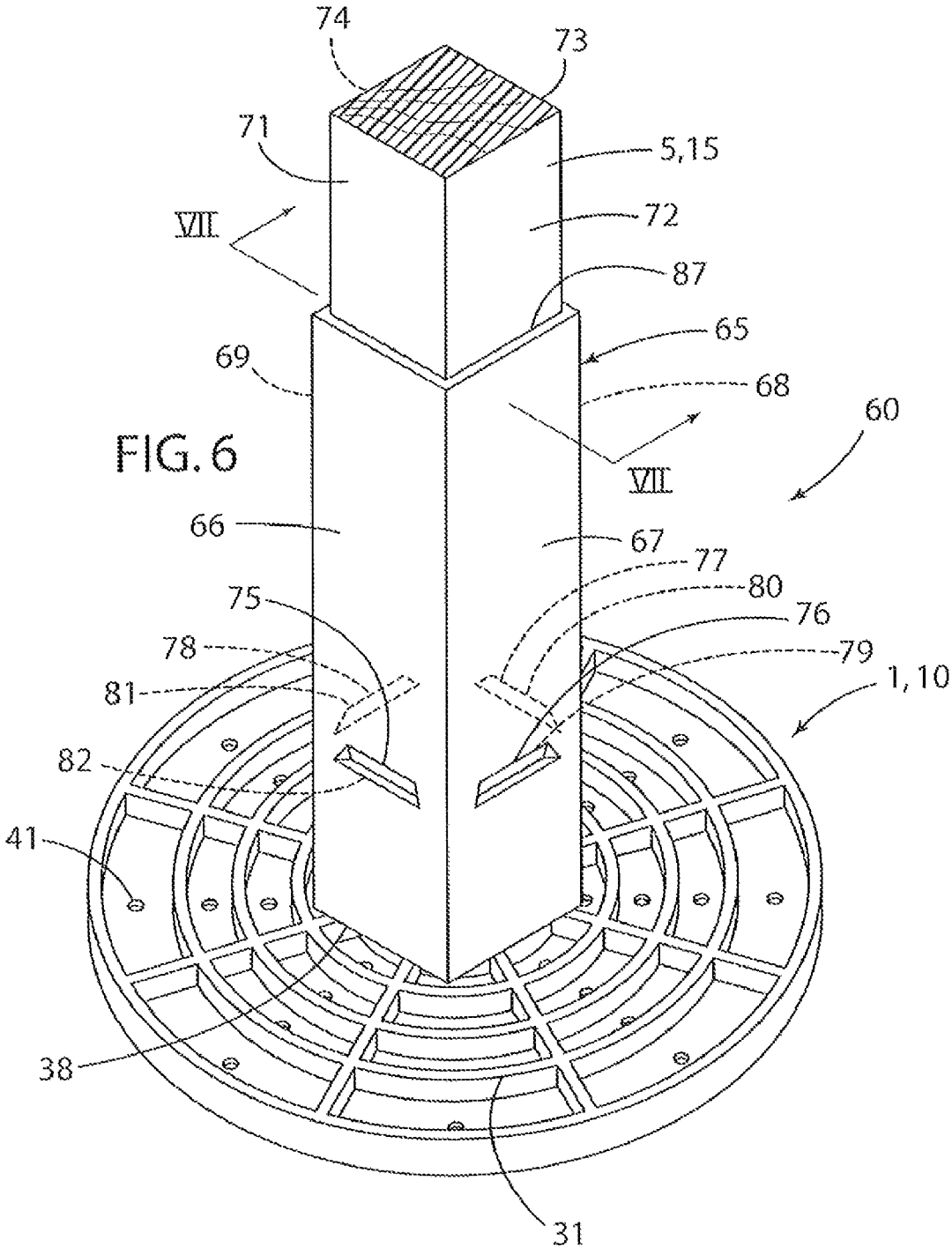
FIG. 6 is an isometric view of a footing form including a protective sleeve for a post according to another aspect of the present invention.
Figure 7:
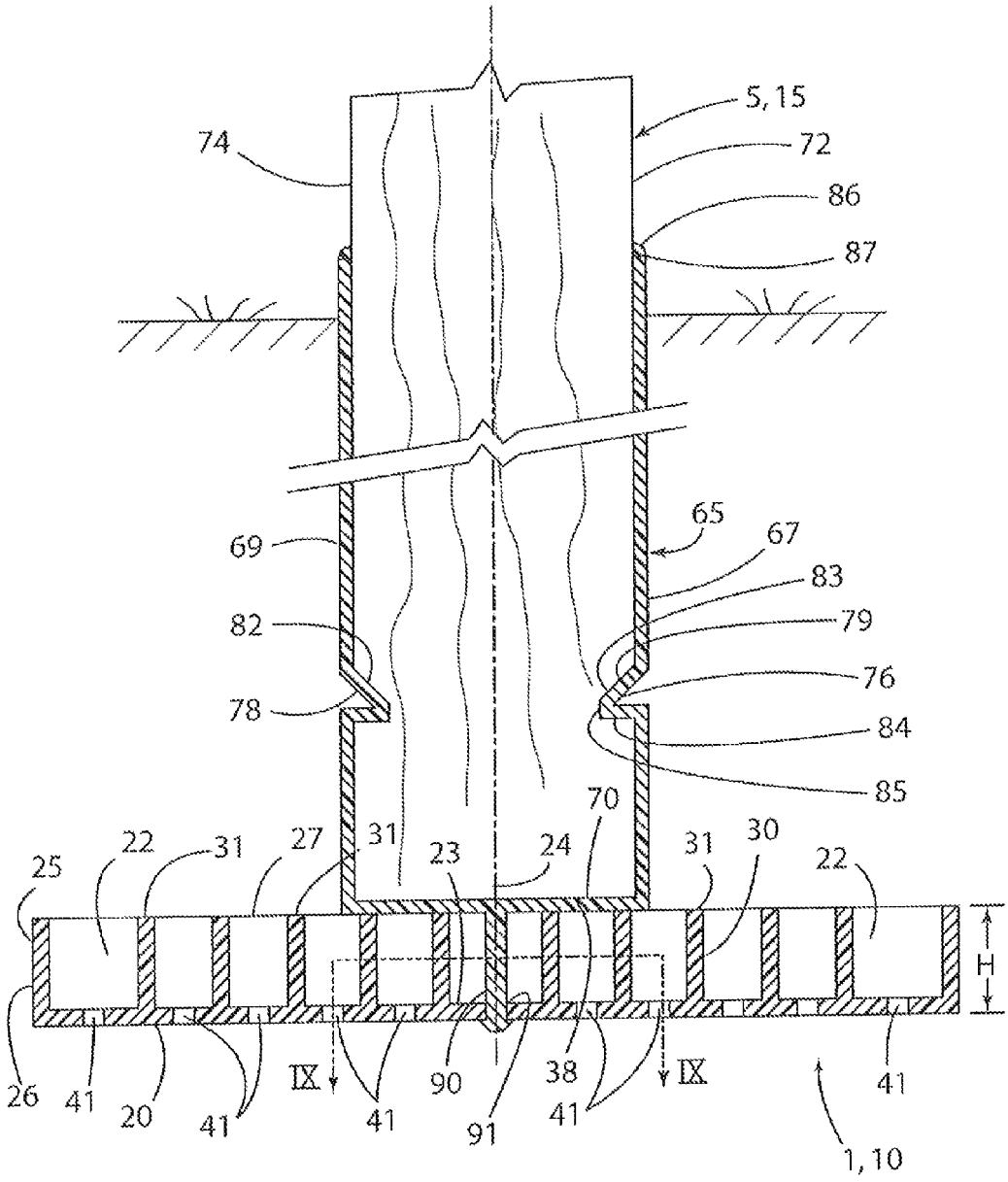
FIG. 7 is a cross-sectional view of the footing form of FIG. 6 taken along the line VII-VII.

With further reference to FIG. 6, a footing form 60 according to another aspect of the present invention may be formed by attaching a post sleeve 65 to a disk-like footing form 1 or 10. The post sleeve 65 includes upright sidewalls 66, 67, 68 and 69 and a base web or sidewall 70 (see also FIG. 7) that fit closely around the outer surfaces of a post 5, 15. In the illustrated example, the posts 5 or 15 comprise 4×4 (actual dimensions 3.5 inches by 3.5 inches), or 6×6 (actual dimensions 5.5 inches by 5.5 inches) square posts, or other suitable members. The sidewalls 66-69 of post sleeve 65 form a square cross-sectional shape that fits closely around outer surfaces 71, 72, 73 and 74 of a post 5 or 15. In the illustrated example, the internal dimensions of the post sleeve 65 are slightly larger than the posts 5, 15 to provide clearance for the posts 5, 15 to slide into the sleeve 65. For example, the post sleeve 65 may have an internal dimension that is ⅛ of an inch larger than a standard post (i.e., 3⅝ inches×3⅝ inches or 5⅝ inches×5⅝ inches). The post sleeve 65 may be made of a suitable polymer material such as polyethylene, PVC, or the like. In a preferred embodiment, the post sleeve 65 does not include reinforcing fibers or the like. Alternately, the post sleeve 65 may be made of the same polymer material with fiber reinforcement as the footing forms 1 and 10 as described in more detail above.

Post sleeve 65 includes one or more retaining lips or barbs 75, 76, 77 and 78 that project inwardly, and engage notches 79, 80, 81 and 82, respectively that may be cut into the side surfaces 71-74 of a post 5 or 15. In the illustrated example, the retaining lips or barbs 75 include a first tapered portion 83 that extends inwardly at an obtuse angle relative to the sidewall, and a second portion 84 (FIG. 7) that may extend at a 90° angle to form one-way barb-like structures. In use, notches 79-82 are cut into the side surfaces 71-74, respectively, of a post 5 or 15 utilizing a saw or the like. The notches 79-82 preferably have side surfaces that correspond to the shape of the first and second tapered portions 83 and 84 of retaining lips or notches 75-78. When a post 5 or 15 is inserted into the post sleeve 65, the lower end 38 of post 5 or 15 slides over the first tapered portion 83 of the retaining lips or barbs 75, and the sidewalls 66-69 of the post sleeve 65 flex outwardly as the end 85 of retaining lips or barbs 75-78 slides along the outer surfaces 71-74 of a post 5, 15. As the post 5, 15 is fully inserted into the post sleeve 65, the end 38 of post 5, 15 eventually contacts base web 70 of post sleeve 65, and the retaining lips or barbs 75-78 are then received into the notches 79-82, respectively, cut into the outer surfaces 71-74 of a post 5 or 15. After the post 5 or 15 is fully inserted into the post sleeve 65 a bead of elastomeric sealant 86 or the like may be applied around the upper end edge 87 of post sleeve 65 to seal the end edge 87 of post sleeve 65 to the post 5 or 15 and thereby prevent entry of moisture, insects, foreign material, or the like into the area between footing form 60 and post 5 or 15. Because the second portion 84 of the retaining lips or notches 75 extends at a 90° angle (or an acute angle), or an angle that is only slightly greater than 90°, the retaining lips or notches 75 retain the post sleeve 65 to the post 5 or 15. In this way, the retaining lips or barbs 75-78 provide a one-way retaining feature that permits the post 5 or 15 to be inserted into the post sleeve 65, but prevent removal of the post 5 or 15 from the post sleeve 65.

Figure 8:
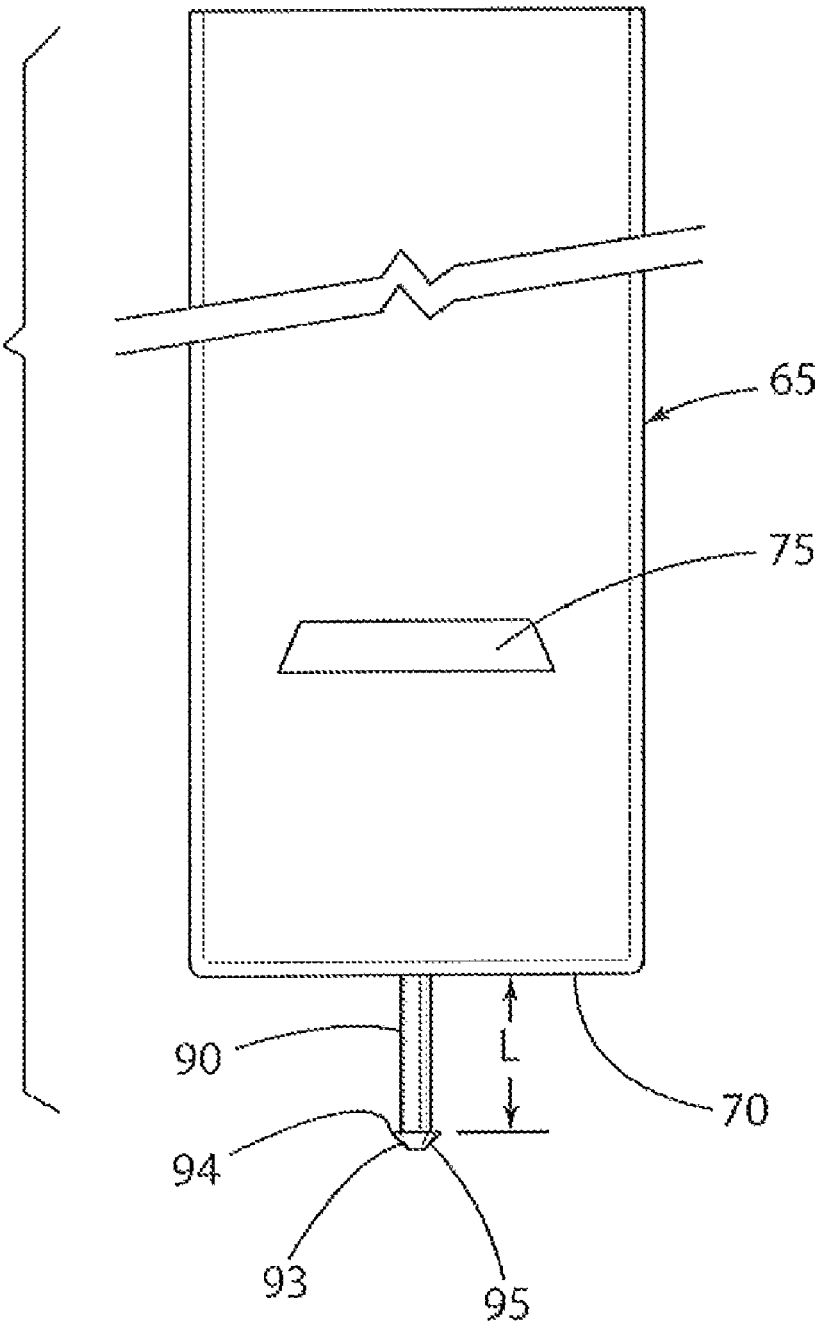
FIG. 8 is a partially fragmentary view of a post sleeve that may be used protect a post or other upright structural member.
Figure 9:
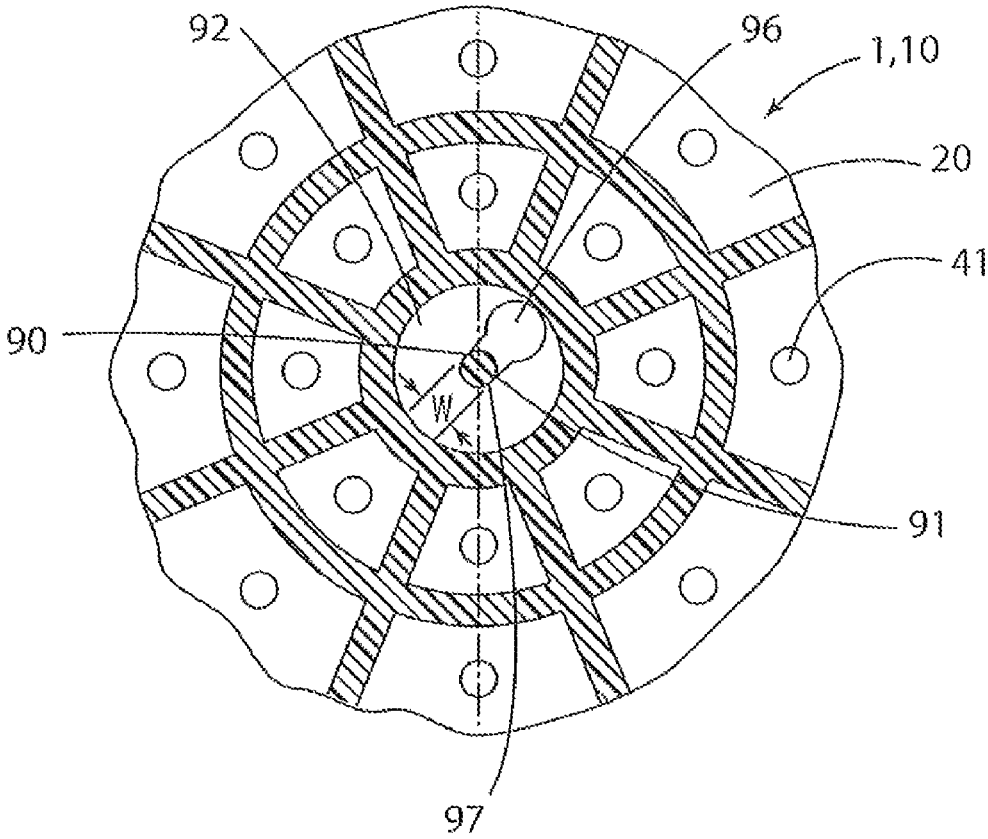
FIG. 9 is an enlarged fragmentary view of a center portion of a disk-like structure including a keyhole-shaped central opening for connecting the post sleeve of FIG. 8 taken along the line IX-IX.

With further reference to FIGS. 8 and 9, post sleeve 65 may include a pin 90 that is received in a keyhole-shaped opening 91 through a center portion 92 of base web 20 of a footing form 1 or 10. Pin 90 includes an enlarged end portion 93 having an annular surface 94 that is spaced a distance "L" away from base web 70 of post sleeve 65. The pin 90 may include a tapered, conical surface 95 that assists in guiding the pin 90 during insertion into keyhole-shaped opening 91 in footing form 1 or 10. The distance L is preferably about the same as the dimension "H" (FIG. 7) of the footing forms 1 and 10 to thereby secure the post sleeve 65 to the forms 1 and 10 in a rigid manner.

The keyhole-shaped opening 91 includes an enlarged portion 96 that is at least as large as the enlarged end 93 of pin 90, such that the enlarged end 93 of pin 90 can be inserted through enlarged portion 96 of keyhole-shaped opening 91. The post sleeve 65 is then shifted relative to the footing form 1 or 10 to thereby position pin 90 in smaller end portion 97 of keyhole-shaped opening 91. The end 97 of keyhole-shaped opening 91 has a width "W" (FIG. 9) that is less than the diameter of the enlarged end portion 93 of pin 90, such that the footing form 60 is securely connected to the footing form 1 or 10 when the pin 90 is positioned in the end 97 of keyhole-shaped opening 91. Engagement of pin 90 in opening 91 thereby interconnects and locates sleeve 65 relative to footing form 1 or 10. Adhesive may be applied to the pin 90 and/or keyhole-shaped opening 91 to thereby adhesively retain the post sleeve 65 to the footing form 1 or 10. Similarly, adhesive may be applied to the base web 70 and/or the upper edge surfaces 31 (FIG. 7) in the areas where the upper surfaces 31 contact the base web 70 of post sleeve 65 to thereby securely adhere the post sleeve 65 to the footing form 1 or 10.

Referring back to FIG. 1, in use, a hole 45 is dug in the earth 46 and a footing form 1 is positioned on the bottom 47 of hole 45. The lower end 6 of post 5 is then positioned on the upper support surface 7 of footing form 1. Fill dirt 48 is then placed in the hole 45 over the footing form 1 and around post 5. Significantly, concrete or the like is not required because the footing form 1 provides sufficient support for the post 5. In the illustrated example, the footing form 1 is about ten inches in diameter. It will be appreciated that other sizes may be utilized as required to provide the desired degree of support. As discussed above, apertures 41 provide for drainage of water and the like that could otherwise form in pockets 40.

With further reference to FIG. 2, a footing form 10 may be positioned in a hole 50 dug into earth 51 to thereby support a post 15 of a building structure 12 such as a pole barn or the like. The footing form 10 is positioned on the bottom 52 of hole 50, and fill dirt 53 is positioned in hole 50 on footing form 10 around post 15. In the illustrated example, the footing form 10 has a diameter of about sixteen inches. The increased size of footing form 10 relative to footing form 1 provides for additional load bearing capability to thereby support the loads associated with the building structure 12.

If the footing form includes a post sleeve 65, notches 79-82 are cut into the sides of the post 5, 15 utilizing a saw or the like. The post sleeve 65 may be connected to the footing form 1 or 10 prior to positioning of the footing form 1 or 10 in the hole 50, and a post 5 or 15 may be then be inserted into the post sleeve 65. Alternately, the footing form 1 or 10 may be positioned in the hole 50, and a post sleeve 65 may be installed on a post 5 or 15. The post sleeve 65 and post 5 or 15 may then be positioned on the footing form 1 or 10 with pin 90 engaging the keyhole-shaped opening 91 as described in more detail above.

The footing form of the present invention provides a very cost-effective support for upright structural members such as posts. The footing form is very quick and easy to use during construction of a building deck, post frame structure, or the like, and thereby reduces the labor and other costs associated with conventional footing arrangements. The structural webs 22, concentric webs 30, and base web 20 provide a structure that distributes the loads outwardly from the post 5 over a relatively large area such that concrete or other conventional supports are not required. Although the footing form has been described as having a diameter of about ten inches or about sixteen inches, it will be readily appreciated that the footing form may have different sizes, shapes, and configurations depending upon the requirements of a particular structure to be supported. Also, although the footing form has been described as having a circular perimeter, with concentric webs, the footing form may have a peripheral shape that is not circular. Furthermore, the base web may be non-planar, and the concentric webs and structural webs may have non-uniform heights.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A stationary building structure, comprising:

a footing form having an upper support surface;

an elongated generally upright structure having a lower end bearing against the upper support surface of the footing form; wherein:

the footing form comprises a generally planar lower web defining a center and a central portion proximate the center, the lower web further defining a peripheral outer edge portion, the footing form including a plurality of upright structural webs extending from the central portion of the lower web to the peripheral outer edge portion of the lower web, the upright structural webs including upper edge surface portions forming at least a part of the upper support surface of the footing form such that loads on the footing form from the upright structural member are distributed outwardly by the upright structural webs to the lower web, the footing form further including a plurality of concentric circular upright webs extending around the center of the lower web, the concentric circular webs, the structural webs, and the lower web together defining a plurality of upwardly-opening pockets; and wherein the lower web includes at least one aperture therethrough to each pocket to provide drainage from the pockets.

2. The building structure of claim 1, wherein:

the structural webs and the concentric webs are integrally formed with the lower web.

3. The building structure of claim 1, wherein:

the structural webs extend radially outwardly.

4. The building structure of claim 1, wherein:

the upper edge portions of the structural webs comprise elongated generally planar surfaces.

5. The building structure of claim 4, wherein:

the concentric webs define generally planar upper edges that are coplanar with the upper edge portions of the structural webs.

6. The building structure of claim 1, wherein:

the lower web defines a circular perimeter.

7. The building structure of claim 6, including:

a circular upright outer web extending upwardly from the circular perimeter of the lower web.

8. The building structure of claim 7, wherein:

the structural webs define outer end portions that are integrally formed with the outer web.

9. The building structure of claim 1, wherein:

the upright structural member comprises a wood post.

10. The building structure of claim 1, wherein:

the footing form comprises a polymer material.

11. The building structure of claim 1, wherein:

the upright structure comprises a post and a waterproof sleeve member disposed on the post, the sleeve member including an upright sidewall portion extending around the post, and a lower horizontal sidewall extending across a lower end of the post.

12. The building structure of claim 11, wherein:

the footing form includes a keyhole-shaped aperture through the central portion of the lower web and a lower surface adjacent the keyhole-shaped aperture;

the sleeve member includes a connecting pin extending from the lower horizontal sidewall through the keyhole-shaped opening, the connecting pin having an enlarged end portion engaging the lower surface of the lower web to retain the sleeve member to the footing form.

13. The building structure of claim 12, wherein:

the keyhole-shaped aperture has an enlarged first portion that is sufficiently large to permit insertion of the enlarged end portion of the connecting pin therethrough.

14. The building structure of claim 11, wherein:

the post comprises a wood member having four vertical side faces, the post including a notch in at least a selected one of the vertical side faces;

the sleeve including a retaining lip extending inwardly from the upright sidewall portion, the retaining lip received in the notch to retain the post in the sleeve member.

15. The building structure of claim 14, wherein:

the retaining lip defines a tapered upper surface forming an obtuse angle relative to the upright sidewall portion of the sleeve member.

16. The building structure of claim 11, wherein:

the post defines four generally vertical side faces;

the upright sidewall portion of the sleeve defines peripheral upper edge portions disposed at an upper end of the sleeve adjacent the vertical side faces of the post; and including:

sealant disposed on the peripheral upper edge and the vertical side faces and forming a waterproof seal between the upper end of the sleeve and the post.

17. A footing form for supporting upright structural members, comprising:

a generally planar lower web defining a center and a central portion proximate the center, the lower web further defining a peripheral outer edge portion, the footing form including a plurality of upright structural webs extending from the central portion of the lower web to the peripheral outer edge portion of the lower web, the upright structural webs including upper edge surface portions forming at least a part of the upper support surface of the footing form such that loads on the footing form from the upright structural member are distributed outwardly by the upright structural webs to the lower web, the footing form further including a plurality of concentric circular upright webs extending around the center of the lower web, the concentric circular webs, the structural webs, and the lower web together defining a plurality of upwardly-opening pockets; and wherein the lower web includes at least one aperture therethrough to each pocket to provide drainage from the pockets.

18. The footing form of claim 17, wherein:

the structural webs and the concentric webs are integrally formed with the lower web.

19. The footing form of claim 17, wherein:

the upper edge portions of the structural webs comprise elongated generally planar surfaces.

20. The footing form of claim 19, wherein:

the concentric webs define generally planar upper edges that are coplanar with the upper edge portions of the structural webs.

21. The footing form of claim 17, wherein:

the lower web defines a circular perimeter.

22. The footing form of claim 21, wherein:

a circular upright outer web extending upwardly from the circular perimeter of the lower web.

23. The footing form of claim 17, wherein:

the lower web and upright structural webs together define a disk-shaped portion having a generally circular outer perimeter; and including:

a sleeve portion extending upwardly from the disk-shaped portion, the sleeve portion including upright sidewall portions and a generally horizontal lower sidewall portion defining a cavity shaped to receive a lower end of a post, wherein the cavity has an open upper end, and wherein the upright sidewalls and the lower sidewall provide a waterproof barrier.

24. The footing form of claim 23, including:

a mechanical connector interconnecting the sleeve portion and the disk-shaped portion.

25. The footing form of claim 23, wherein:

the mechanical connector includes a pin received in an aperture.

26. The footing form of claim 25, wherein:

the pin is formed integrally with the sleeve, and extends downwardly from the horizontal lower sidewall portion.

27. The footing form of claim 23, wherein:

the sleeve portion includes at least one retainer extending inwardly into the cavity from the upright sidewall portion.

28. The footing form of claim 27, wherein:

the one retainer includes a tapered upper surface that forms a barb.

29. The footing form of claim 23, wherein:

the sleeve portion comprises a one-piece polymer member having four upright sidewalls forming a square tubular structure.

30. A footing form kit, comprising:

a lower member having upper and lower opposite side faces, a central portion including a first connecting structure, and a peripheral outer edge, the lower member comprising a generally horizontal web and a plurality of upright webs that are integrally formed with the horizontal web and extend radially outward from the central portion;

an elongated sleeve member having a generally tubular construction with an open upper end and a closed lower end, the sleeve member defining a cavity configured to receive a lower end of a post, wherein the sleeve forms a waterproof barrier that prevents entry of water into the cavity, and wherein the sleeve member includes a second connecting structure adapted to engage the first connecting structure and interconnect the sleeve member and the lower member with the sleeve member extending upwardly above the upper side face of the lower member.

31. The footing form kit of claim 30, wherein:

the first connecting structure is an integrally formed part of the lower member.

32. The footing form kit of claim 30, wherein:

the second connecting structure is an integrally formed part of the sleeve member.

33. The footing form kit of claim 30, wherein:

the first connecting structure comprises an aperture; and the second connecting structure comprises a male member adapted to be received in the aperture.

34. The footing form kit of claim 30, wherein:

the sleeve member has four vertical sidewalls forming a square cross-sectional shape configured to fit closely around a conventional four-by-four square post.

35. The footing form kit of claim 30, wherein:

the sleeve member includes at least one barb protruding therefrom into the cavity, wherein the barb comprises a one-way barb configured to engage a slot cut into a side face of a post to prevent removal of the post from the sleeve.

36. The footing form kit of claim 35, wherein:

the sleeve member includes four upright sidewalls, each sidewall having a one-way barb protruding into the cavity.

37. A footing form kit, comprising:

a lower member having upper and lower opposite side faces, a central portion, and a peripheral outer edge, the lower member comprising a generally horizontal web and a plurality of upright webs that are integrally formed with the horizontal web, the central portion of the lower member including a first connecting structure comprising an aperture;

an elongated sleeve member having a generally tubular construction with an open upper end and a closed lower end, the sleeve member defining a cavity configured to receive a lower end of a post, wherein the sleeve forms a waterproof barrier that prevents entry of water into the cavity, and wherein the sleeve member includes a second connecting structure comprising a male member adapted to be received in the aperture and interconnect the sleeve member and the lower member with the sleeve member extending upwardly above the upper side face of the lower member; and wherein:

the male member has an enlarged end portion; and the aperture is formed in the generally horizontal web, and has an enlarged first portion sized to permit insertion of the enlarged end portion of the male member therethrough, the aperture having a second portion with a reduced size preventing insertion and removal of the enlarged end portion of the male member therethrough.

38. A stationary building structure, comprising:

a footing form having a generally flat upper support surface defining a center;

an elongated generally upright wood post having a lower end abuttingly supported on the upper support surface of the footing form with the post positioned in a horizontally offset position relative to the center of the footing form; and wherein:

the footing form comprises a generally planar lower web defining a center and a central portion proximate the center, the lower web further defining a peripheral outer edge portion, the footing form including a plurality of upright structural webs extending from the central portion of the lower web to the peripheral outer edge portion of the lower web, the upright structural webs including upper edge surface portions forming at least a part of the upper support surface of the footing form such that loads on the footing form from the upright wood post are distributed outwardly by the upright structural webs to the lower web, the footing form further including a plurality of concentric upright webs extending around the center of the lower web.

* * * * *